US008453959B2

(12) United States Patent
Sartain et al.

(10) Patent No.: US 8,453,959 B2
(45) **Date of Patent: *Jun. 4, 2013**

(54) REWINDER WEB CHOP WITH EARLY DETECTION AND WEB DIVERSION TO ELIMINATE EQUIPMENT DAMAGE

(75) Inventors: Kevin B. Sartain, Broken Arrow, OK (US); Matthew Robert Wilson, Oshkosh, WI (US); Vivek Moreshwar Karandikar, Neenah, WI (US); Paul Louis Bartocci, Bear, DE (US); Jeffrey Wasylyk, Cochranville, PA (US); Damon Otis Branch, Philadelphia, PA (US); James Daniel Rucinski, Broken Arrow, OK (US); James Leo Baggot, Menasha, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/448,752

(22) Filed: Apr. 17, 2012

(65) Prior Publication Data

US 2012/0193464 A1 Aug. 2, 2012

Related U.S. Application Data

(63) Continuation of application No. 11/217,102, filed on Aug. 31, 2005, now Pat. No. 8,157,199.

(51) Int. Cl.
*B65H 26/02* (2006.01)

(52) U.S. Cl.
USPC ..... 242/534.1; 242/563.1

(58) Field of Classification Search
USPC ..... 242/534, 523, 534.1, 563, 563.1; 226/11, 226/45
See application file for complete search history.

(56) References Cited

U.S. PATENT DOCUMENTS

| | | | |
|---|---|---|---|
| 4,532,500 | A | 7/1985 | Henk |
| 4,754,702 | A | 7/1988 | Mueller |
| 5,024,156 | A | 6/1991 | Hank et al. |
| 5,130,557 | A | 7/1992 | Kettl |
| 6,543,353 | B1 | 4/2003 | Ohlhauser et al. |
| 6,553,270 | B1 | 4/2003 | Houle et al. |
| 6,561,064 | B1 | 5/2003 | Hada et al. |
| 6,651,923 | B2 | 11/2003 | Kinnunen et al. |

(Continued)

FOREIGN PATENT DOCUMENTS

| | | |
|---|---|---|
| DE | 24 03 748 | 7/1975 |
| DE | 101 57 914 | 8/2002 |

(Continued)

OTHER PUBLICATIONS

Annex to Communication from EP 06 784 538.8 dated Apr. 20, 2011—4 pages.

(Continued)

*Primary Examiner* — William E Dondero
(74) *Attorney, Agent, or Firm* — Dority & Manning, P.A.

(57) ABSTRACT

Generally, the present disclosure is directed to, in one embodiment, a process for controlling a converting line web. More specifically, a sheet material is provided on the converting line. A loss of control is detected in the sheet material web and the sheet material web is broken at a location upstream from the converting line web rewinder. The broken sheet material web is redirected.

24 Claims, 5 Drawing Sheets

U.S. PATENT DOCUMENTS

| | | | | |
|---|---|---|---|---|
| 6,813,941 | B2 | 11/2004 | Beuther et al. | |
| 6,918,485 | B2 | 7/2005 | Holston et al. | |
| 8,157,199 | B2 * | 4/2012 | Sartain et al. | 242/534.1 |
| 2002/0117575 | A1 | 8/2002 | Gilmore et al. | |
| 2003/0111572 | A1 | 6/2003 | Wilson et al. | |
| 2003/0201361 | A1 | 10/2003 | Stephens et al. | |
| 2004/0118964 | A1 | 6/2004 | Long | |

FOREIGN PATENT DOCUMENTS

| | | |
|---|---|---|
| DE | 102 22 586 | 12/2003 |
| DE | 103 38 973 | 4/2004 |
| DE | 103 12 384 | 6/2004 |
| GB | 2 017 649 | 10/1979 |

OTHER PUBLICATIONS

Annex to Communication from EP 06 784 538.8 dated Feb. 13, 2012—5 pages.

PCT Search Report and Written Opinion from PCT/US2006/021355 dated Apr. 10, 2006—9 pages.

* cited by examiner

REWINDER WEB CHOP WITH EARLY DETECTION AND WEB DIVERSION TO ELIMINATE EQUIPMENT DAMAGE

CROSS-REFERENCE TO RELATED APPLICATION

The present application is a continuation of U.S. application Ser. No. 11/217,102 having a filing date of Aug. 31, 2005. Applicants claim priority to and benefit of all such applications and incorporate all such application herein by reference.

BACKGROUND OF THE INVENTION

High-speed rewinder machines are used in the paper industry for producing consumer sized logs or rolls of bathroom tissue, paper towels, and the like, from large parent rolls of the material. The smaller logs are then cut transversely into individual consumer rolls of a desired length. The industry is continuously seeking ways and devices to improve the operating efficiency and reliability of such rewinder machines. It is critical that rewinder machines operate with relatively great precision and reliability while the web is moving at high speeds.

However, a web break can greatly reduce the maximum output from a converting line. The majority of web breaks that occur in a converting line are caused in the rewinder head area. A web break may lead to severe equipment damage as well as downtime associated with thread-up delays.

A significant problem with current systems is that they are designed for and focused on making process adjustments after a web break has already occurred. Such conventional systems do not take into account certain predictive characteristics indicating that a loss of web control is imminent.

As a result, while existing systems have been employed to cut-off the web to limit damage from breaks and wrap-ups, existing systems are unable to anticipate or predict a web break until it has already occurred.

Accordingly, a need exists to minimize the severity and associated downtime due to web breaks or web wraps in the converting line by limiting the amount of sheet that can be involved in a break.

A need also exists for a system that would maintain sheet control through the majority of the converting line during a web break or web wrap in the rewinder area. It follows that a need exists for a system that reduces damage to equipment and that reduces clean-up time for web breaks.

SUMMARY OF THE INVENTION

Generally, the present disclosure is directed to, in one embodiment, a process for controlling a converting line web. A sheet material is provided on the converting line and the converting line has of a parent roll and a rewinder. A loss of control is detected in the sheet material web prior to a complete break in the sheet material web and the sheet material web is broken at a location upstream from the converting line web rewinder. The broken sheet material web is redirected.

The loss of control in the sheet material web may be detected by sheet deflection of the sheet material web where the sheet deflection is greater than 1 inch. The loss of control in the sheet material web may be detected by a partial break in the sheet material. The loss of control in the sheet material web may be detected by a change in average tension in the sheet material web where change in average tension is less than 4 lbs or preferably less than 10 lbs. The sheet material web may be broken by a rotating web chop. The sheet material may be broken at a location less than 2 feet upstream from the rewinder. The broken sheet material may be redirected by subjecting the broken sheet material web to a high pressure gas. The broken sheet material may also be rethreaded. Control may be maintained over the sheet material web upstream from the sheet material web break.

In one embodiment, a converting line web control system is provided. The system has a parent roll and a rewinder with the parent roll having a sheet material web. The system has at least one detection device capable of detecting a loss of control of the web prior to a complete break in the sheet material web. The system has a web cut-off mechanism located upstream from the converting line web rewinder and a web control mechanism for redirecting the web.

Additional advantages of the present subject matter are set forth in, or will be apparent to, those of ordinary skill in the art from the detailed description herein. Also, it should be further appreciated that modifications and variations to the specifically illustrated, referred and discussed features and elements hereof may be practiced in various embodiments and uses of the invention without departing from the spirit and scope of the subject matter. Variations may include, but are not limited to, substitution of equivalent means, features, or steps for those illustrated, referenced, or discussed, and the functional, operational, or positional reversal of various parts, features, steps, or the like.

Still further, it is to be understood that different embodiments, as well as different embodiments, of the present subject matter may include various combinations or configurations of presently disclosed features, steps, or elements, or their equivalents (including combinations of features, parts, or steps or configurations thereof not expressly shown in the figures or stated in the detailed description of such figures). Additional embodiments of the present subject matter, not necessarily expressed in the summarized section, may include and incorporate various combinations of aspects of features, components, or steps referenced in the summarized objects above, and/or other features, components, or steps as otherwise discussed in this application. Those of ordinary skill in the art will better appreciate the features and aspects of such embodiments, and others, upon review of the remainder of the specification.

BRIEF DESCRIPTION OF THE FIGURES

A full and enabling disclosure of the present invention including the best mode thereof, directed to one of ordinary skill in the art, is set forth in the specification, which includes and makes reference to the appended figures, in which.

Figure 1:
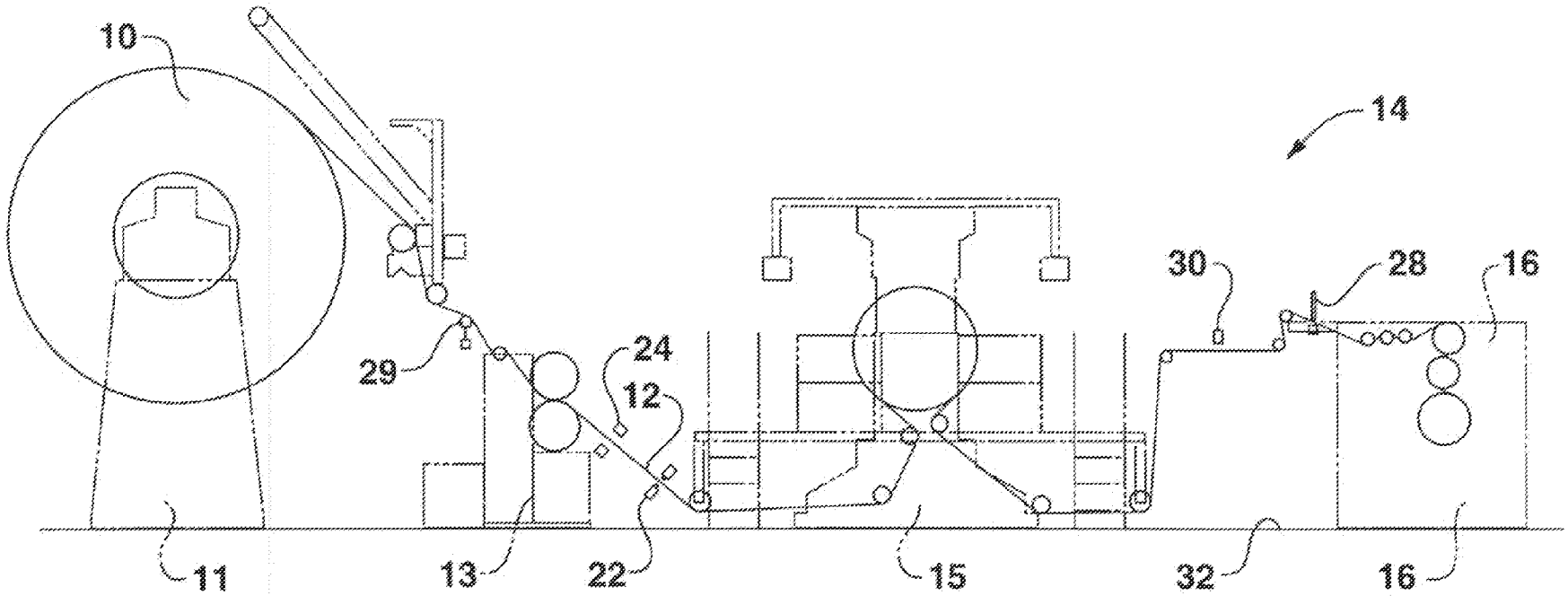
FIG. 1 is an elevational view of a system in accordance with an aspect of the present disclosure.

Repeated use of reference characters throughout the present specification and appended drawings is intended to represent the same or analogous features or elements of the invention.

DETAILED DESCRIPTION OF THE INVENTION

Reference will now be made in detail to embodiments of the invention, at least one example of which is illustrated in the drawings. Each embodiment is provided by way of explanation of the invention, and not meant as a limitation of the invention. For example, features illustrated or described as part of one embodiment may be used with another embodiment to yield still a further embodiment. It is intended that the invention includes these and other modifications and variations as come within the scope and spirit of the invention.

In general, the present disclosure is directed to systems and processes for early detection, and the prevention of, the loss of web control. The present disclosure has application to the converting operations of a variety of sheet material webs in roll form that include, but are not limited to, paper, tissue, textiles, nonwovens, films, foils, laminates thereof, and so forth.

In this regard, loss of control refers to any event that upsets, interferes with, or otherwise destabilizes the ongoing process conditions of the converting operations. A typical such loss of control is one that either causes unacceptable product to be made, or one causing the process controller to recognize and/or report an anomalous process condition, or both. In many instances, such a loss of control results in a web break that may cause downtown and equipment damage.

The term "web," as used herein, is meant to include a sheet material made of one or more plies of material so that a multiple-ply sheet material is considered to be a "web" of sheet material, regardless of the number of plies. In addition, the terms "downwardly," "upwardly," "forward", "rearward", "left" and "right" as used herein are intended to indicate the direction relative to the views presented in the Figures.

Referring to FIG. 1, during the converting line 14 operations, sheet material 12 (as used herein, the terms "sheet material" and "web" are used interchangeably) is unwound from a parent roll 10. The sheet material 12 is depicted traveling from left to right. The main sections of the converting line are the unwinder 11, calender 13, printer 15 and rewinder 16.

As described previously, high-speed converting lines 14 are used in the paper industry for producing consumer sized logs from large parent rolls 10 of the sheet material 12. The smaller logs are then cut transversely into individual consumer rolls of a desired length. Optionally, the sheet material 12 may travel through additional converting operations prior to being rewound. Exemplary optional converting operations include, but are not limited to, slitting, embossing, calendering, perforating, and so forth. After traveling through the optional converting operations, the sheet material 12 enters the rewinder 16.

The majority of loss of control and resulting sheet breaks that occur in a converting line 14 occur in the rewinder area 16. In accordance with the present disclosure, the area of the converting line 14 where web breaks are most likely to occur is isolated from the rest of the converting line 14, while a system to prevent the sheet from breaking upstream is employed. Through systems and processes of the present disclosure, a potential web break can be detected 0.1 ms-5 seconds before a web break occurs. Such detection helps avoid equipment damage by limiting the amount of sheet material 12 that can be pulled into the rewinder 16 during a sheet break and keeping the sheet material 12 threaded in other sections of the converting operation. The sheet break can be removed and the rewinder section can be quickly rethreaded.

The system of the present disclosure is essentially comprised of three major parts. First, the system detects imminent loss of control of the sheet material 12. Second, following detection of loss of control, the sheet material 12 is broken. Third, the sheet material 12 is redirected. These three parts may occur sequentially or simultaneously.

With respect to early detection of loss of control of sheet material 12, a wide variety of detection devices can be used in accordance with the present disclosure as in FIGS. 2-5. For example, sensors may be located along the converting line 14 at positions selected to enable the sensors to detect the condition of the web in relationship with a desired parameter. Typical sensors include tension measuring rolls 20 (FIG. 2), photo-eyes 22 (FIG. 3), proximity sensors 24 (laser, LED, ultrasonic) (FIG. 4), displacement sensors 26 (laser, LED, ultrasonic) (FIG. 5), log diameter sensors, and line scan cameras. One or more such sensors may be utilized in accordance with the present disclosure. Other sensors can be used as well so long as such sensors can be set up to suitably communicate with a controller.

Figure 2:
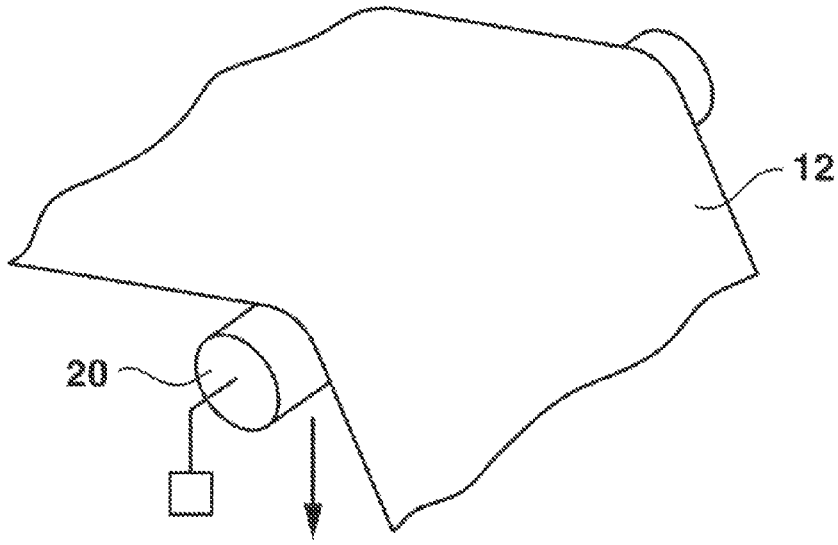
FIG. 2 is a perspective view of a detection device in accordance with an aspect of the present disclosure.

Referring to the embodiment in FIG. 2, a tension measuring roll 20 is depicted. Load sensors are disposed on the ends of the tension measuring roll 20 for sensing stress loading on the turning roll transverse to its axis, the stress loading on the turning rolls being interpreted as tension on web 12. The load sensors on the tension measuring roll 20 are able to detect changes in web tension resulting from a loss of web control. Running tension on the tension measuring roll 20 in a converting line may range from 5 lbs-30 lbs. However, running tension may vary depending on the speed and type of web on a converting line 14.

In some embodiments, the controller may collect data from the tension measuring roll 20 to determine an average tension. The controller will trigger a loss of control based on sudden changes in the average tension data. In other embodiments, the controller will analyze data from the tension measuring roll 20 indicating that tension is less than 2 lbs and trigger a web break.

Figure 3:
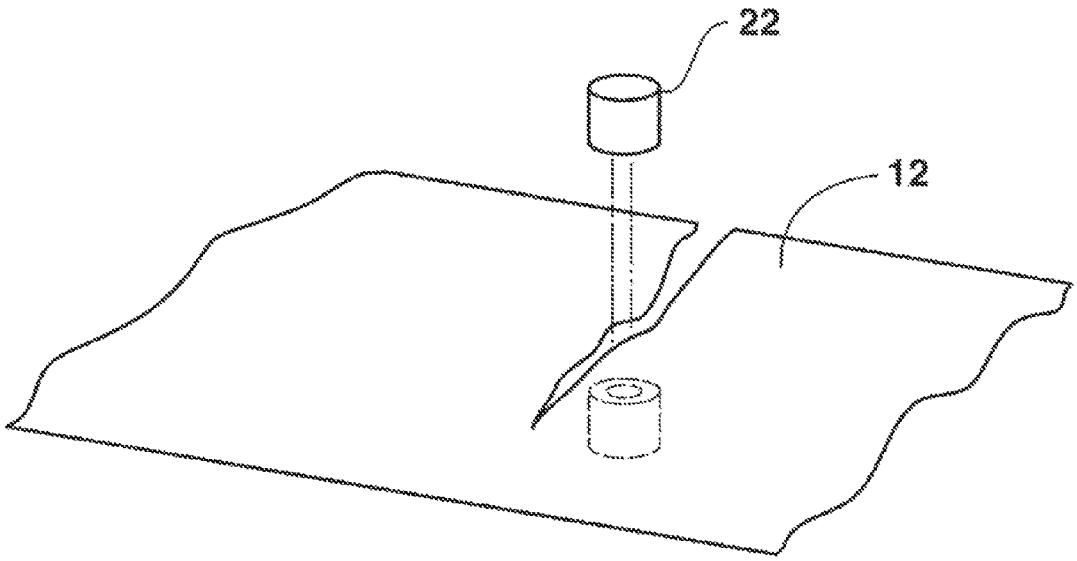
FIG. 3 is a perspective view of a detection device in accordance with an aspect of the present disclosure.

Turning to the embodiment in FIG. 3, a photo-eye 22 is depicted. A photo-eye 22 is able to detect a partial or complete break in the sheet material 12 during the converting operations. Such a break in the sheet material 12 is indicative of a loss of control.

Figure 4:
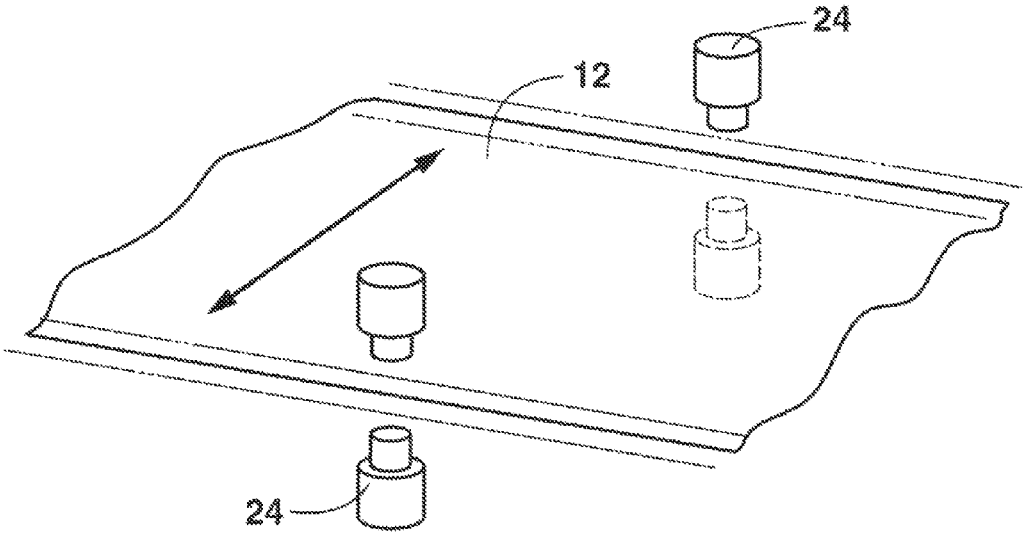
FIG. 4 is a perspective view of a detection device in accordance with an aspect of the present disclosure.

Proximity sensors 24 are depicted in FIG. 4. The relative position of the edges of the sheet material 12, are sensed by upper and lower proximity sensors 24. If the sheet material edges are straying from their normal path, the proximity sensor 24 will indicate a loss of control. In some embodiments, the proximity sensor 24 indicates a loss of control when a sheet material edge strays 1 inch or greater from its normal path. In other embodiments, a loss of control is indicated when a sheet material edge strays 2 inches or greater from its normal path and in still other embodiments, a loss of control is indicated when a sheet material edge strays 3 inches or greater from its normal path.

Figure 5:
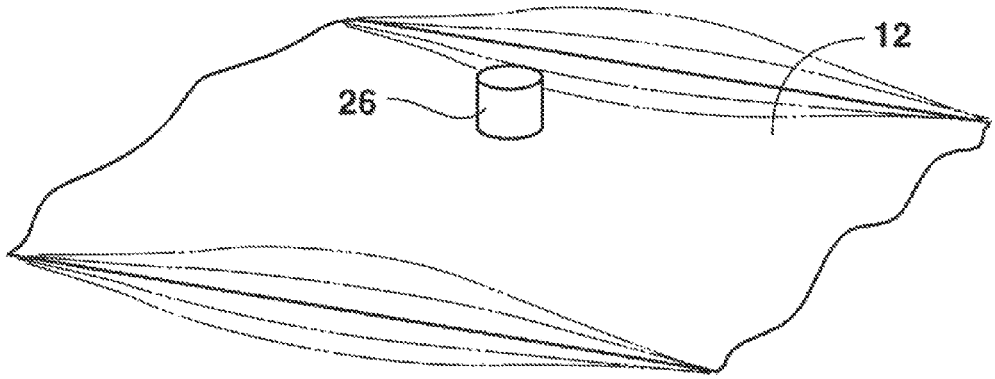
FIG. 5 is a perspective view of a detection device in accordance with an aspect of the present disclosure.

An exemplary optional detection device is depicted in FIG. 5. Displacement sensor 26 (also known as a "sheet flutter sensor") detects changes in sheet material deflection. In some embodiments, Banner LED® displacement sensors are mounted on opposite sides of the sheet material 12. The displacement sensors 26 are located 10" from the sheet surface and 3' from a roll edge. The displacement sensors 26 measure the displacement of the sheet material 12 from its normal running plane. The displacement sensor 26 has a resolution of 4 mm. Other embodiments may have resolutions of less than 4 mm. Changes in sheet deflection as measured by the displacement sensors 26 indicate a loss of control.

In some embodiments, sheet deflection of 0.5 inches or more will indicate a loss of control. In other embodiments, sheet deflection of 1.5 inches or more will indicate a loss of control. In still other embodiments, sheet deflection of 2.5 inches or more will indicate a loss of control.

The detection devices all feed their inputs into a computer controller. The computer controller processes the one or several inputs to determine if the sheet material 12 will be broken.

In some embodiments, the primary control center of the system is the Rewinder ControlLogix processor (RWLA). Other suitable computer control platforms can similarly provide the functions illustrated here by the RWLA computer controller. Accordingly, the invention is not limited to RWLA computer controller, but can be practiced on other computer platforms so long as the necessary elements of logic analysis are available.

The controller can concurrently be collecting, analyzing, and acting upon data pertaining to a variety of parameters and collected from a variety of detection devices concurrently associated with a variety of work pieces. Typically, the controller is programmed to trigger the web break after having received a suitable number of data readings from a sensor indicating that a loss of control has occurred and a web break is imminent. In some embodiments, the controller determines an average for the parameter being measured from a particular detection device and will trigger a loss of control based on sudden deviations from that average.

A converting line 14 can include one controller or multiple controllers and such controllers may also be programmed to trigger other events, such as shutting down the converting line 14. In some embodiments, activation of the controller only occurs after a certain line speed is reached. In some embodiments, line speeds in which the controller is activated range from 300 ft/min.-2000 ft/min.

Figure 7:
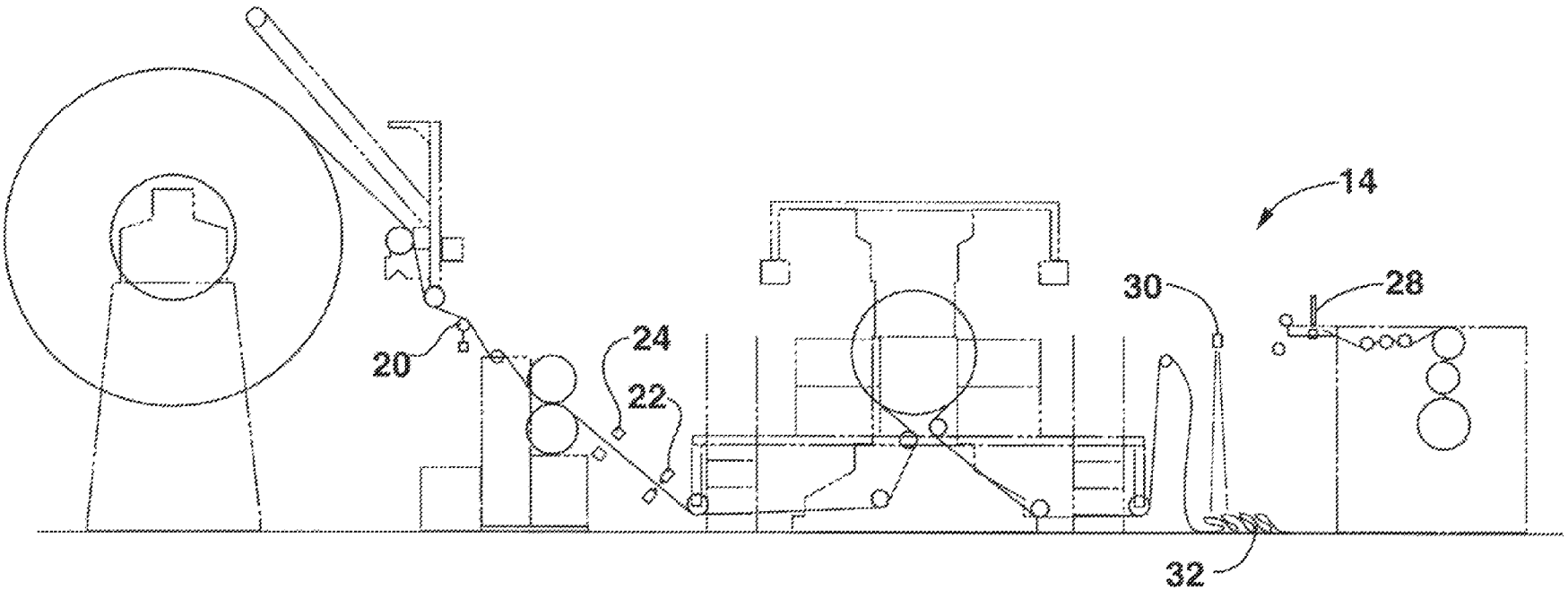
FIG. 7 is an elevational view of a system in accordance with an aspect of the present disclosure.

Referring to FIG. 7, upon detection of loss of control, the sheet material 12 is broken. Web cut-off assemblies 28 are well known in the art as "web chop" mechanisms. Such devices are provided to periodically sever or break the web in a web cutting event. In some embodiments, a rotating web chop is utilized which breaks the sheet material 12 by pinching the sheet material 12 between a rotating stationary element. In some embodiments, the rotating web chop actuation time is less than 0.15 seconds. However, it should be understood that any suitable device may be used for web cut-off assembly 28.

A cut-off assembly 28 is depicted in FIG. 7. In some embodiments, the sheet material may be broken at a location ranging from at least 20 feet-less than 1 foot upstream from the rewinder 16. In some embodiments, the cut-off assembly 28 may be located only a few inches from the rewinder 16.

Next, the sheet material 12 is redirected. As discussed previously, many breaks in sheet material 12 occur in the rewinder 16. Thus, it is important that control of the sheet material 12 is maintained as close to the rewinder 16 as possible so that once the sheet material 12 is broken, it can be redirected to a location where it can be collected to provide for easy rethread so as to reduce the amount of intervention required by the operator to reduce downtime.

In some embodiments, the web cut-off assemblies 28 sever the sheet material 12 at the same time the sheet material 12 is redirected. In this regard, in some embodiments, control of the sheet material 12 can be achieved by using nipped rollers employing either blades or air showers to prevent the sheet material 12 from wrapping, use of a vacuum roll for winding the web on a roller, or by the use of air knives to the sheet material 12 in a controlled manner to the floor or other position.

Figure 6A:
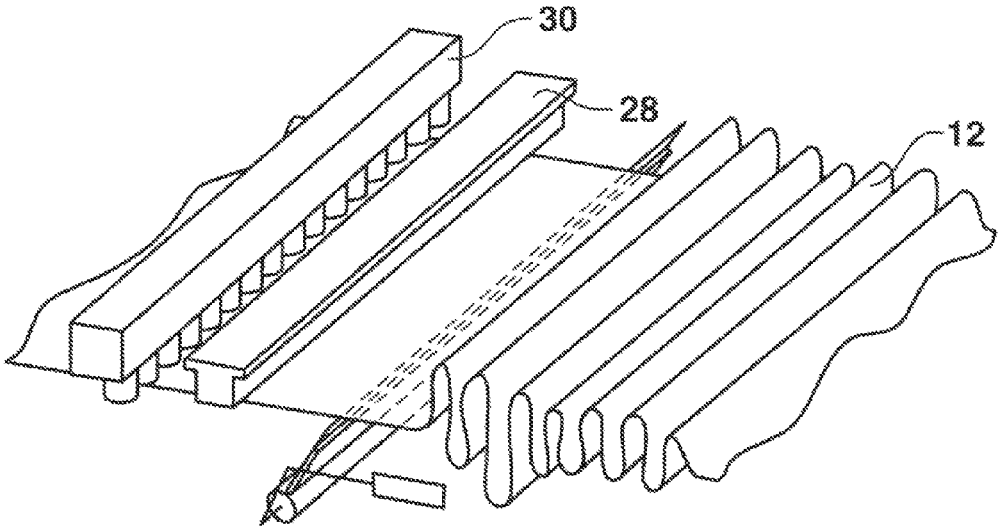
FIGS. 6A and 6B are perspective sequential views of a web control mechanism in accordance with an aspect of the present disclosure.
Figure 6B:
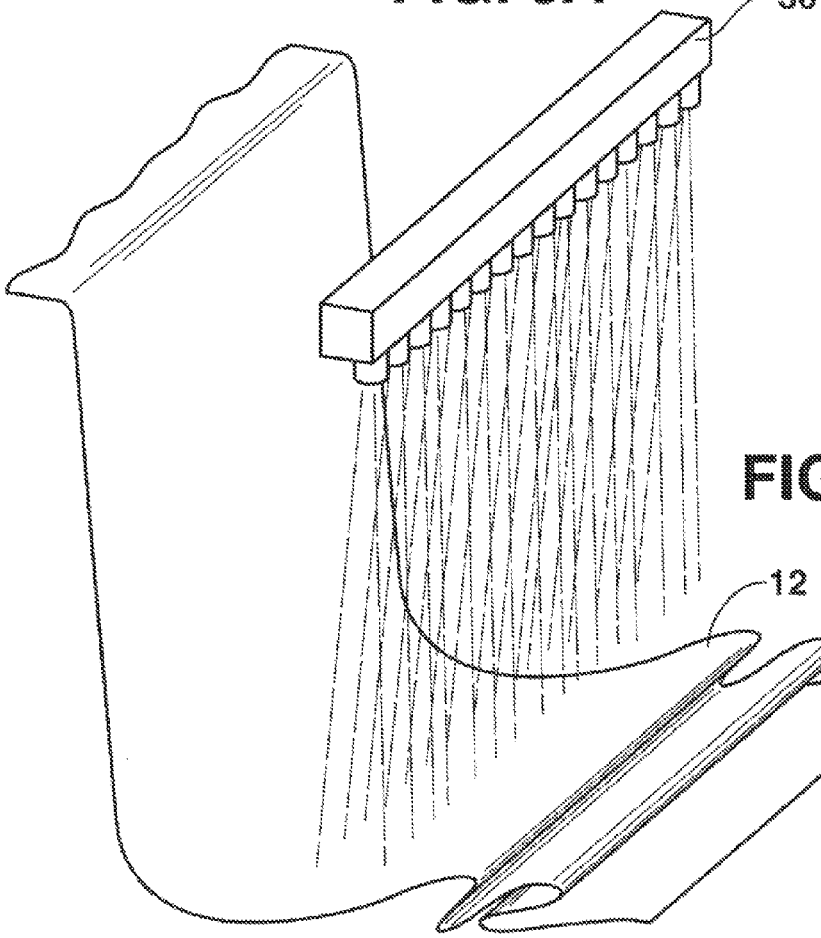

Referring to FIGS. 6A and 6B, an air knife 30 in accordance with one embodiment of the present disclosure is depicted. The air knife 30 is the driving force to draw the sheet material 12 to the converting line floor 32 after the sheet material 12 has been broken. In some embodiments, an Exair Super Air Knife® is utilized to deliver a high speed stream of air which will provide tension to the web after a loss of control is detected to allow a web break by the cut-off assembly 28. The air knife 30 will be located above the sheet material 12 and pointed downstream at an angle towards the sheet material 12 of approximately 5 to 15 degrees. The location of the air knife 30 is upstream of the rewinder 16.

The sheet material 12 is directed to a location on the converting line floor 32 where it can be collected to provide for easy re-thread and reduce the amount of intervention required by the operator to reduce downtime. The system and processes described herein help avoid equipment damage by limiting the amount of sheet material 12 that can be pulled into the rewinder 16 during a break and keeping the sheet threaded on the other sections of the converting operation even after a break occurs. In this manner, loss of control of the sheet material 12 is isolated to the area near the rewinder 16 while other converting sections remain threaded. This allows the sheet break to be removed and the rewinder 16 can be quickly rethreaded.

It will be appreciated that the foregoing examples, given for purposes of illustration, are not to be construed as limiting the scope of this invention. Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention which is defined in the following claims and all equivalents thereto. Further, it is recognized that many embodiments may be conceived that do not achieve all of the advantages of some embodiments, yet the absence of a particular advantage shall not be construed to necessarily mean that such an embodiment is outside the scope of the present invention.

What is claimed is:

1. A process for controlling a converting line web, comprising the steps of:

providing a sheet material web on said converting line, said converting line comprising a parent roll and a rewinder;

detecting a loss of control in said sheet material web prior to a complete break in said sheet material web, the loss of control being determined by a controller;

breaking said sheet material web at a location upstream from the converting line web rewinder; and redirecting the broken sheet material web.

2. A process as in claim 1, wherein said loss of control in said sheet material web comprises detecting sheet deflection of said sheet material web.

3. A process as in claim 2, wherein said sheet deflection is greater than 1 inch.

4. A process as in claim 1, wherein said loss of control in said sheet material web comprises detecting a partial break in said sheet material web.

5. A process as in claim 1, wherein said loss of control in said sheet material web comprises detecting a change in average tension in said sheet material web.

6. A process as in claim 5, wherein said change in average tension is less than 4 lbs.

7. A process as in claim 5, wherein said change in average tension is less than 10 lbs.

8. A process as in claim 1, wherein said sheet material web is broken by a rotating web chop.

9. A process as in claim 1, wherein said sheet material web is broken at a location less than 2 feet upstream from said rewinder.

10. A process as in claim 1, wherein said broken sheet material web is redirected by subjecting said broken sheet material web to a high pressure gas.

11. A process as in claim 1, further comprising the step of rethreading the broken sheet material web.

12. A process as in claim 1, further comprising the step of maintaining control of said sheet material web upstream from said location of said sheet material web break.

13. A converting line web control system comprising:

a converting line, said converting line comprising a parent roll and a rewinder, said parent roll comprising a sheet material web;

at least one detection device capable of detecting a loss of web control prior to a complete break in said sheet material web;

a controller configured to determine a loss of web control;

a web cut-off mechanism located upstream from said rewinder; and a web control mechanism for redirecting said web.

14. A system as in claim 13, wherein at least one said detection device comprises a displacement sensor.

15. A system as in claim 13, wherein at least one said detection device comprises a photo-eye.

16. A system as in claim 13, wherein at least one said detection device comprises a load cell.

17. A system as in claim 13, wherein said web cut-off mechanism comprises a rotating web chop.

18. A system as in claim 13, wherein said web cut-off mechanism is at least 10 feet upstream from said rewinder.

19. A system as in claim 13, wherein said web cut-off mechanism is at least 5 feet upstream from said rewinder.

20. A system as in claim 13, wherein said web cut-off mechanism is at least 2 feet upstream from said rewinder.

21. A system as in claim 13, wherein said web control mechanism comprises an air knife.

22. A system as in claim 13, wherein said detection device provides data, said controller collecting, analyzing, and acting upon data from at least one said detection device.

23. A system as in claim 22, wherein said controller initiates said web cut-off mechanism.

24. A system as in claim 22, wherein said controller initiates said web control mechanism.

* * * * *